United States Patent [19]

Rohner et al.

[11] Patent Number: 4,565,058

[45] Date of Patent: Jan. 21, 1986

[54] MAKE-READY UNIT FOR MAKING A THREAD END READY

[75] Inventors: Joachim Rohner; Reinhard Mauries; Heinz Zumfeld, all of Monchen-Gladbach, Fed. Rep. of Germany

[73] Assignee: W. Schlafhorst & Co., Monchen-Gladbach, Fed. Rep. of Germany

[21] Appl. No.: 710,101

[22] Filed: Mar. 11, 1985

[30] Foreign Application Priority Data

Mar. 9, 1984 [DE] Fed. Rep. of Germany ..... 3408668

[51] Int. Cl.[4] ..... B65H 69/06; D01H 15/00; D02J 1/08

[52] U.S. Cl. ..... 57/22; 57/261

[58] Field of Search ..... 57/22, 23, 261, 262, 57/202

[56] References Cited

U.S. PATENT DOCUMENTS

| | | | |
|---|---|---|---|
| 4,263,775 | 4/1981 | Mima | 57/22 |
| 4,414,798 | 11/1983 | Matsui et al. | 57/22 |
| 4,423,586 | 1/1984 | Matsui | 57/22 |
| 4,432,197 | 2/1984 | Ueda et al. | 57/261 |
| 4,439,978 | 4/1984 | Mima | 57/22 |
| 4,445,317 | 5/1984 | Mima | 57/261 X |
| 4,446,687 | 5/1984 | Mima | 57/261 X |
| 4,476,671 | 10/1984 | Rohner et al. | 57/261 |
| 4,481,761 | 11/1984 | Kimura | 57/22 |

*Primary Examiner*—John Petrakes

*Attorney, Agent, or Firm*—Herbert L. Lerner; Laurence A. Greenberg

[57] ABSTRACT

A make-ready unit for making a thread end ready preparatory to connecting it with another thread end in a thread splicing device, the make-ready unit having a thread splicing device, the make-ready unit having a thread channel formed in a hollow body and traversible by a gas flow produced by injected gas, the thread channel being open at both ends for receiving the thread end transitorily therein, including a pressure-gas guiding device formed as a first ring channel surrounding the hollow body and having at least one pressure-gas supply location, the thread channel being formed with a thread inlet end through which the thread end is received and having a funnel-shaped flaring portion at the thread inlet end extending from a main cylindrical part of the thread channel, and a likewise funnel-shaped cover formed with a central opening and covering the funnel-shaped flaring portion of the thread channel in such manner that a second ring channel defined by conical surfaces extends from the first ring channel to the main cylindrical part of the thread channel.

9 Claims, 5 Drawing Figures

MAKE-READY UNIT FOR MAKING A THREAD END READY

The invention relates to a make-ready unit for making a thread-end ready preparatory to connecting it with another thread end in a thread splicing device and, more particularly, to such a make-ready unit having a thread channel formed in a hollow body and traversible by a gas flow produced by injected gas, the thread channel being open at both ends for receiving the thread end transitorily therein.

If two threads are to be connected to one another by splicing, it is necessary in specific cases to at least partly stretch the fibers of the thread ends beforehand, as well as paralellize them and separate short fibers therefrom. The threads generally have a thread twist which must be removed in the region of the thread ends so that the individual fibers lie in the best possible stretched condition in best possible parallel relationship to one another. Thread ends made ready in this manner are drawn out of the make-ready unit or make-ready units and then connected to one another by splicing, in that the individual fibers of both thread ends alternatingly intermix under the action of splicing air, hook together, wind around one another and finally mutually intertwine due to a reintroduced thread twist. A thread twist may be either a Z-twist or an S-twist. The make-ready units are set, respectively, for a specific thread twist and, when a change in the thread twist is to be made, they must be exchanged or converted with costly manual labor.

It is accordingly an object of the invention to provide a make-ready unit which makes a thread end ready satisfactorily in a relatively short line for a subsequent splice connection and, simultaneously, provides the prerequisites which avoids any necessity for exchanging or converting the make-ready unit when the twist of a thread is to be changed.

With the foregoing and other objects in view, there is provided, in accordance with the invention, a make-ready unit for making a thread end ready preparatory to connecting it with another thread end in a thread splicing device, the make-ready unit having a thread channel formed in a hollow body and traversible by a gas flow produced by injected gas, the thread channel being open at both ends for receiving the thread end transitorily therein, comprising a pressure-gas guiding device formed as a first ring channel surrounding the hollow body and having at least one pressure-gas supply location, the thread channel being formed with a thread inlet end through which the thread end is received and having a funnel-shaped flaring portion at the thread inlet end extending from a main cylindrical part of the thread channel, and a likewise funnel-shaped cover formed with a central opening and covering the funnel-shaped flaring portion of the thread channel in such manner that a second ring channel defined by conical surfaces extends from the first ring channel to the main cylindrical part of the thread channel.

To loosen or untwist a Z-twist, the thread end is fed to the make-ready unit, for example, to the right-hand side above the pressure-gas supply location, and to untwist an S-twist to the left-hand side above the pressure-gas supply location. Without having to change anything in the make-ready unit, the twist-loosening or relaxation successfully occurs solely due to appropriate selection of the direction from which the thread end is introduced into the make-ready unit.

In accordance with an added feature of the invention the funnel-shaped flaring portion terminates at an edge extending concentrically to and around the thread channel.

In accordance with another feature of the invention, the pressure-gas supply location is disposed opposite the edge and at substantially the same level as the edge.

In accordance with a further feature of the invention, the second ring channel has a width at its narrowest location of from 0.2 mm to 0.6 mm.

In accordance with still another feature of the invention, the first ring channel has a height of from 5 mm to 10 mm and a width of from 0.3 mm to 0.6 mm.

In accordance with yet an added feature of the invention, the pressure-gas supply location has a cross section of at most 10 $mm^2$.

In accordance with yet an additional feature of the invention, the funnel-shaped flaring portion has an aperture angle of substantially 90°.

In accordance with again a further feature of the invention, the pressure-gas guiding device has another pressure-gas supply location spaced from the one pressure-gas supply location, both of the pressure-gas supply locations being selectively connectible to a source of pressure gas.

In accordance with a concomitant feature of the invention, the thread channel is formed with a constriction downstream of the funnel-shaped flaring portion in direction of gas flow.

Each of the foregoing features of the invention provides a further advance in the art of making a thread end ready for splicing.

If the pressure-gas guiding device, in accordance with the invention, has two pressure-gas supply locations which are mutually spaced apart and each of the two pressure-gas supply locations is connectible selectively to a pressure-gas source, the possibility is then afforded of feeding the thread end, independently of the thread twist, always from the same side to the make-ready unit. If the thread has a Z-twist, the one pressure-gas supply location is connected to the pressure-gas source, and if the thread has an S-twist, then the other pressure-gas supply location is so connected.

Other features which are considered as characteristic for the invention are set forth in the appended claims.

Although the invention is illustrated and described herein as embodied in a make-ready unit for making a thread end ready, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
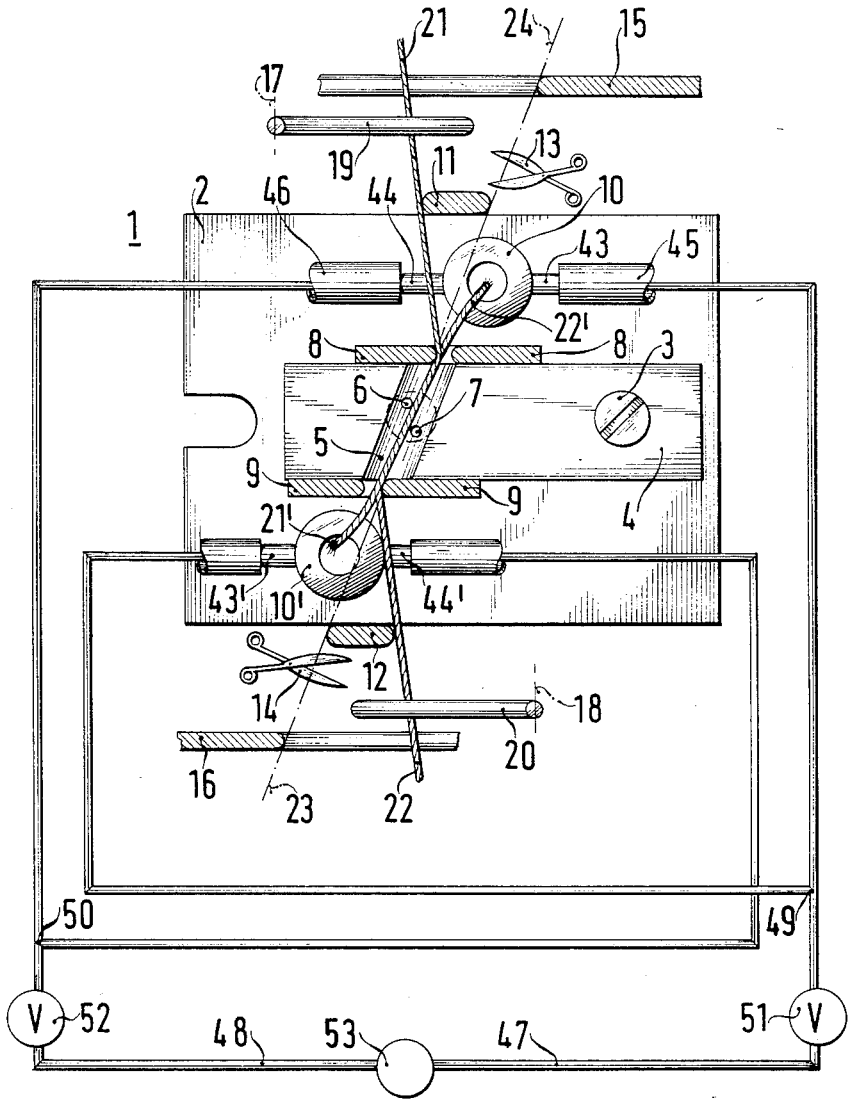
FIG. 1 is a diagrammatic and partly schematic front elevational view of a thread splicing device incorporating the make-ready unit according to the invention.
Figure 2:
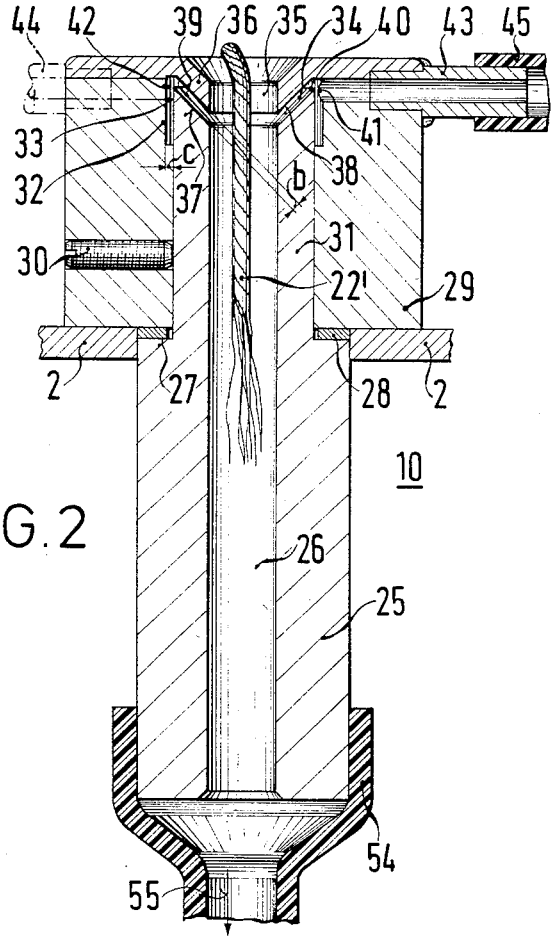
FIG. 2 is a longitudinal sectional view of the make-ready unit.
Figure 3:
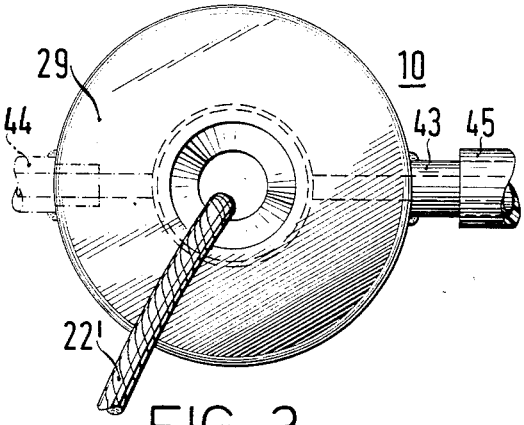
FIG. 3 is an enlarged fragmentary front elevational view of FIG. 1 showing the make-ready unit.

Referring now to the drawing and first, particularly, to FIGS. 1 to 3 thereof, there is shown a thread-splicing device identified as a whole by reference numeral 1 which is made up of a base plate 2 whereon a splicing head 4 is fastened by a screw 3. The splicing head 4 is formed with a slot-shaped splicing chamber 5 which, at the instant of splicing, may be closed by a non-illustrated cover. Two splicing-air bores 6 and 7 terminate in the splicing chamber 5. At an upper outlet of the splicing chamber 5, a thread and air guide plate 8 is disposed and, at a lower outlet of the splicing chamber 5, a thread and air guide plate 9. In vicinity of the thread and air guide plate 9, a make-ready unit 10 is set into the base plate 2 and, in vicinity of the thread and air guide plate 9, a make-ready unit 10 is set into the base plate 2 and, in vicinity of the thread and air guide plate 9, a similar make-ready unit 10'. A thread guide plate 11 is located at an upper edge of the front plate 2, and a thread guide plate 12 at the lower edge of the base plate 2. A symbolically represented thread severing device 13 is located in vicinity of the thread guide plate 11, and a similar thread severing device 14 in vicinity of the thread guide plate 23. A further thread guide plate 15 is disposed above the thread severing device 13, and yet another thread guide plate 16 below the thread severing device 14. A loop puller 19 pivotable about an axis 17 is located between the thread guide plate 11 and the thread guide plate 15, and a similar loop puller 20 pivotable about an axis 18 is located between the thread guide plate 12 and the thread guide plate 16.

A thread 21 coming from above is to be spliced with a thread 22 coming from below. A thread end 21' of the thread 21 initially follows the dot-dash line 23 before the thread-severing device 14 is actuated. A thread end 22' of the thread 22 initially follows the dot-dash line 24 before the thread-severing device 13 is actuated.

Both of the make-ready units 10 and 10' are constructed like that of the embodiment of the make-ready unit 10 shown in FIGS. 2 and 3. According to FIGS. 2 and 3, the make-ready unit 10 has a tubular hollow body 25 open at both ends thereof and formed with a central thread channel 26. A washer 28 is supported on a shoulder 27, and a head 29 on the washer 28, the head 29 being fastened by a screw 30 to a neck 31 of the hollow body 25. The head 29 is formed with a recess 32 directed towards the neck 31, so that a ring channel 33 is formed which surrounds the upper end of the neck 31 of the hollow body 25.

The thread channel 26 has, at a thread input end thereof, a funnel-shaped enlargement or flared portion 34 which has an aperture angle of about 90°. The funnel-shaped flared portion 34 is so covered by a likewise funnel-shaped cover 36 formed with a central opening 35 that a second ring channel 39 defined by conical surfaces 37 and 38 extends from the first-mentioned ring channel 33 to the thread channel 26. The funnel-shaped flared portion 34 terminates at an edge 40 extending concentrically with and around the thread channel 26.

The first ring channel 33 has two pressure-gas supply locations, namely a first pressure-gas supply location 41 shown in section and a second pressure-gas supply location 42 shown in phantom. The second pressure-gas supply location 42 is located opposite the first pressure-gas supply location 41. The representation of the second pressure-gas supply location 42 in phantom is to indicate that it may be omitted under certain conditions as an alternative embodiment. A nipple or connecting pipe 43 is connected with the pressure-gas supply location 41, and a similar nipple or connecting pipe 44 with the pressure-gas supply location 42.

According to FIG. 1, a pressure-gas line 45 is connected to the connecting pipe 43, and a pressure-gas line 46 to the connecting pipe 44.

Because the make-ready unit 10' is constructed exactly like the make-ready unit 10, in FIG. 1, the corresponding connecting pipe of the make-ready unit 10' is identified by reference characters 43' and 44'. FIG. 1 shows that the pressure-gas line 45 is also connected with the connecting pipe 43' and via a branching point 49 to a valve 51. A pressure-gas line 47 extends from a pressure-gas or compressed gas source 53 to the valve 51, and a pressure-gas line 48 also to a valve 52.

It is apparent from FIG. 2 that the pressure-gas supply locations 41 and 42 are disposed opposite the edge 40 and at substantially the same height or level as that of the edge 40.

Connected to the lower end of the hollow body 25 is a hose 54 which serves to lead away or draw off the flowing air in direction of the arrow 55.

According to FIG. 1, the thread 22 comes from below and the right-hand side of the figure, changes its direction at the thread and air guide plate 9, lies extended in the splicing chamber 5, and then follows the dot-dash line 24. The thread 21 comes from above and the left-hand side of FIG. 1, changes its direction at the thread and air guide plate 8, lies adjacent the thread 22 in the splicing chamber, and follows the dot-dash line 23.

The instant that the splicing chamber 5 is then closed by a non-illustrated cover, both thread severing devices 13 and 14 are actuated. The thread 22 thereafter forms a thread end 22', and the thread 21 a thread 21'. The cut-off thread length is removed by non-illustrated conventional means.

Even before the thread severing devices 13 and 14 have been actuated, the make-ready units 10 and 10' may have air injected therein. Depending upon the existing twist of the thread, the air injection occurs by opening one of the two valves 51 or 52. The selected valve may also be opened at intervals. Furthermore, the possibility also exists of opening both valves alternatingly or simultaneously, and this also at intervals, if so chosen. Various possibilities also exist of pneumatically acting upon the thread ends 21 and 22'. If it is preferred, for example, to open and close both valves 51 and 52 alternatingly at brief intervals, it is unnecessary to determine beforehand what twist had been imparted to the thread.

The injector air flowing out of the pressure-gas line 45, the pressure gas line 46 or both of the pressure-gas lines 45 and 46 into the first ring channel 33 passes over the edge 40 into the second ring channel 39 and from there directed at a downward inclination or declination into the thread channel 26 where it excites an air flow in direction of the arrow 55. Air flowing in through the central opening 35 is thereby entrained. Simultaneously, a vortex is formed in the thread channel 26 which contributes to the loosening or intwisting of the thread and to a pretreatment of the thread ends. The air flow also tightly holds the respective thread end whereby, in turn, the splicing operation may be facilitated.

In performing the splicing operation, both thread ends 21' and 22' are initially withdrawn a given amount or, indeed, entirely from the thread channels 26. The two loop pullers 19 and 20 perform this function. They swing out of the vertical position thereof indicated by the small circles and come into contact with the threads 21 and 22, respectively, as shown in FIG. 1. They thereby form thread loops, and the lengths of thread required for this purpose are then obtained by pulling back or withdrawing the thread ends from the thread channels.

The splicing per se is accomplished by introducing a flow of pressure gas through the splicing air bores 6 and 7 into the splicing chamber 5. In the splicing chamber 5, the fibers of the two mutually adjacent threads are hooked to one another, whirled around and intertwined. The pulling back or withdrawing of the thread from the make-ready units may be so adjusted to the splicing operation that only short thread ends or even only thread ends protrude from the complete splicing location.

FIG. 2 shows that the second ring channel 39 has the same width b over the entire length thereof. If the cover 36 were to have had a different apperture angle than that of the funnel-shaped flaring portion 34, the width of the second ring channel 39 would not be uniformly equal and a constriction would be formed either at the inlet or at the outlet of the ring channel 39. The adjustment of the constriction and of the ring-channel width is effected by the addition of washers 28 of varying thickness.

By employing added washers, it is relatively easy to adjust the desired width quite exactly within a range of from 0.2 mm to 0.6 mm.

The width c of the first ring channel 33 is not as critical. It is predetermined beforehand and is, for example, from 0.3 mm to 0.6 mm. Also, the cross section of the pressure-gas supply location which may be, for example, a maximum of 10 $mm^2$ is determined beforehand in harmony with the entire pneumatic system.

Figure 4:
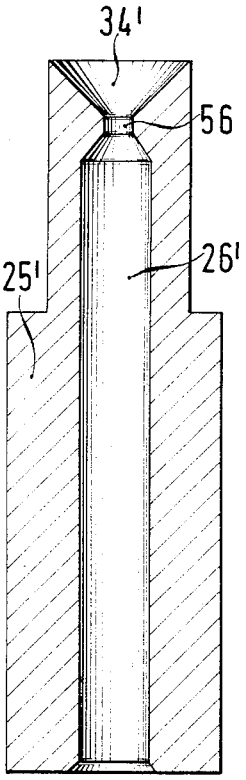
FIG. 4 is a longitudinal sectional view of another embodiment of the hollow body of the make-ready unit of FIG. 2.
Figure 5:
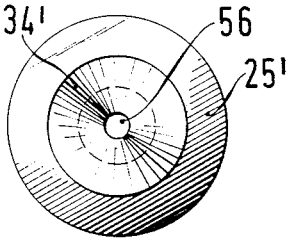
FIG. 5 is a front or end view of the hollow body of FIG. 4.

In the alternative construction of a hollow body 25' according to FIGS. 4 and 5, the thread channel 26' has a constriction 56 formed therein downstream of the funnel-shaped flaring portion 34', as viewed in direction of air flow. The thread ends are given an especially intensive pneumatic treatment at the constriction 56.

As noted, the invention is not limited merely to the embodiments described hereinbefore and illustrated in the figures.

The foregoing is a description corresponding in substance to German Application No. P 34 08 668.4, dated Mar. 9, 1984, the International priority of which is being claimed for the instant application, and which is hereby made part of this application. Any material discrepancies between the foregoing specification and the aforementioned corresponding German application are to be resolved in favor of the latter.

We claim:

1. Make-ready unit for making a thread end ready preparatory to connecting it with another thread end in a thread splicing device, the make-ready unit having a thread splicing device, the make-ready unit having a thread channel formed in a hollow body and traversible by a gas flow produced by injected gas, the thread channel being open at both ends for receiving the thread end transitorily therein, comprising a pressure-gas guiding device formed as a first ring channel surrounding the hollow body and having at least one pressure-gas supply location, the thread channel being formed with a thread inlet end through which the thread end is received and having a funnel-shaped flaring portion at said thread inlet end extending from a main cylindrical part of the thread channel, and a likewise funnel-shaped cover formed with a central opening and covering said funnel-shaped flaring portion of the thread channel in such manner that a second ring channel defined by conical surfaces extends from said first ring channel to said main cylindrical part of the thread channel.

2. Make ready unit according to claim 1, wherein said funnel-shaped flaring portion terminates at an edge extending concentrically to and around the thread channel.

3. Make-ready unit according to claim 2, wherein said pressure-gas supply location is disposed opposite said edge and at substantially the same level as said edge.

4. Make-ready unit according to claim 1, wherein said second ring channel has a width at its narrowest location of from 0.2 mm to 0.6 mm.

5. Make-ready unit according to claim 1, wherein said first ring channel has a height of from 5 mm to 10 mm and a width of from 0.3 mm to 0.6 mm.

6. Make-ready unit according to claim 1, wherein said pressure-gas supply location has a cross section of at most 10 $mm^2$.

7. Make-ready unit according to claim 1, wherein said funnel-shaped flaring portion has an aperture angle of substantially 90°.

8. Make-ready unit according to claim 1, wherein said pressure-gas guiding device has another pressure-gas supply location spaced from said one pressure-gas supply location, both of said pressure-gas supply locations being selectively connectible to a source of pressure gas.

9. Make-ready unit according to claim 1, wherein the thread channel is formed with a constriction downstream of said funnel-shaped flaring portion in direction of gas flow.

* * * * *